US010865804B2

(12) United States Patent
Mikami et al.

(10) Patent No.: US 10,865,804 B2
(45) Date of Patent: Dec. 15, 2020

(54) CENTRIFUGAL COMPRESSOR IMPELLER

(71) Applicant: IHI Corporation, Koto-ku (JP)

(72) Inventors: Chihiro Mikami, Koto-ku (JP); Ryuuta Tanaka, Koto-ku (JP)

(73) Assignee: IHI Corporation, Koto-ku (JP)

( * ) Notice: Subject to any disclaimer, the term of this patent is extended or adjusted under 35 U.S.C. 154(b) by 161 days.

(21) Appl. No.: 15/778,057

(22) PCT Filed: Feb. 1, 2017

(86) PCT No.: PCT/JP2017/003643
§ 371 (c)(1),
(2) Date: May 22, 2018

(87) PCT Pub. No.: WO2017/145686
PCT Pub. Date: Aug. 31, 2017

(65) Prior Publication Data

US 2018/0347581 A1 Dec. 6, 2018

(30) Foreign Application Priority Data

Feb. 23, 2016 (JP) ..... 2016-032242

(51) Int. Cl.
*F04D 29/30* (2006.01)
*F04D 29/28* (2006.01)

(52) U.S. Cl.
CPC ..... *F04D 29/30* (2013.01); *F04D 29/284* (2013.01)

(58) Field of Classification Search
CPC ..... F04D 29/24; F04D 29/242; F04D 29/284; F04D 29/30; F04D 29/68; F04D 29/681; F01D 5/048; F01D 5/141
USPC ..... 416/223 B
See application file for complete search history.

(56) References Cited

U.S. PATENT DOCUMENTS

| | | | |
|---|---|---|---|
| 5,685,696 | A | 11/1997 | Zangeneh et al. |
| 2009/0035122 | A1 | 2/2009 | Yagi et al. |
| 2010/0129224 | A1 | 5/2010 | Shibata et al. |
| 2011/0173975 | A1 | 7/2011 | Sun et al. |
| 2012/0189454 | A1 | 7/2012 | Iwakiri et al. |
| 2016/0195094 | A1 | 7/2016 | Yamashita |

FOREIGN PATENT DOCUMENTS

| | | | |
|---|---|---|---|
| EP | 2 020 509 | A2 | 2/2009 |
| JP | 10-504621 | A | 5/1998 |
| JP | 2010-151126 | A | 7/2010 |
| JP | 2011-226398 | A | 11/2011 |
| JP | 2011-236919 | A | 11/2011 |
| JP | 102333961 | A | 1/2012 |
| JP | 2015-75040 | A | 4/2015 |

OTHER PUBLICATIONS

International Search Report dated Apr. 4, 2017 in PCT/JP2017/003643, 1 page.

*Primary Examiner* — Woody A Lee, Jr.
*Assistant Examiner* — Justin A Pruitt
(74) *Attorney, Agent, or Firm* — Obion, McClelland, Maier & Neustadt, L.L.P.

(57) ABSTRACT

Provided is a centrifugal compressor impeller that includes blades extending from an inlet to an outlet for a fluid. Each of the blades of the impeller includes, when a distribution of blade angles of a tip is viewed in a direction in which the tip extends from a tip inlet to a tip outlet for the tip, a constant blade angle region in which the blade angles are constant. A start point on the inlet side of the constant blade angle region is set at a position spaced apart from the tip inlet.

1 Claim, 7 Drawing Sheets

CENTRIFUGAL COMPRESSOR IMPELLER

TECHNICAL FIELD

The present disclosure relates to a centrifugal compressor impeller.

BACKGROUND ART

Conventionally, as technology of this field, an impeller set forth in Patent Literature 1 below is known. A tip of each blade of the impeller has a constant tip angle region in which blade angles are constant from an inlet toward an outlet, and an increasing tip angle region in which the blade angles are continuously gradually increased on the outlet side of the constant tip angle region. It is proposed in Patent Literature 1 that compression efficiency of the impeller is improved by the above configuration.

CITATION LIST

Patent Literature

[Patent Literature 1] Japanese Unexamined Patent Publication No. 2015-75040

SUMMARY OF INVENTION

Technical Problem

In this type of centrifugal compressor impeller, further improvement of the efficiency is required. An object of the present disclosure is to provide a centrifugal compressor impeller that improves efficiency.

Solution to Problem

A centrifugal compressor impeller according to an aspect of the present disclosure has blades extending from an inlet to an outlet for a fluid, in which each of the blades includes, when a distribution of blade angles of a tip is viewed in a direction in which the tip extends from a tip inlet to a tip outlet for the tip, a constant blade angle region in which the blade angles are constant, and a start point on the inlet side of the constant blade angle region is set at a position spaced apart from the inlet.

Effects of Invention

According to the centrifugal compressor impeller of the present disclosure, efficiency can be improved.

DESCRIPTION OF EMBODIMENTS

A centrifugal compressor impeller according to an aspect of the present disclosure includes blades extending from an inlet to an outlet for a fluid. When a distribution of blade angles of a tip is viewed in a direction in which the tip extends, each of the blades includes a constant blade angle region in which the blade angles are constant. A start point on the inlet side of the constant blade angle region is located at a position spaced apart from the inlet.

A normalized meridional distance of the inlet-side start point from the inlet may be set to be 0.05 m/m2 or more. The constant blade angle region may be made to be within a region between a point at which the normalized meridional distance from the inlet is 0.05 m/m2 and a point at which the normalized meridional distance from the inlet is 0.40 m/m2. When the blade angle at the start point on the inlet side is defined as a blade angle β1, the blade angle of each point within the constant blade angle region may be made to be an angle within a range of (β1±1)°. A width of the constant blade angle region may be made to be 0.05 m/m2 or more on the basis of the normalized meridional distance. The distribution of the blade angles may make a minimal value exist within the constant blade angle region.

Figure 1:
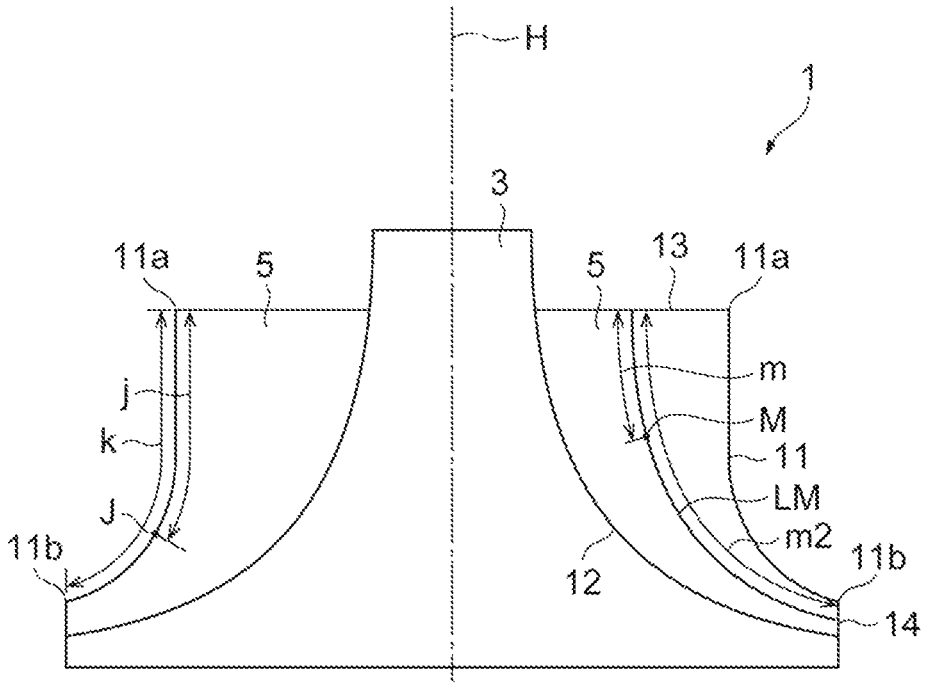
FIG. 1 is a view illustrating a centrifugal compressor impeller according to an embodiment.

Hereinafter, an impeller according to the present disclosure will be described in detail with reference to the drawings. The impeller 1 of the present embodiment is, for instance, a centrifugal compressor impeller used as an impeller for a compressor or the like of a supercharger. As illustrated in FIG. 1, the impeller 1 includes a hub 3 that rotates about a rotation axis H, and a plurality of blades 5 that are formed on a circumference of the hub 3 and extend from an inlet to an outlet for a fluid. A configuration of this centrifugal compressor impeller is widely known, and thus further detailed description will be omitted.

FIG. 1 illustrates a state in which the blades 5 are projected onto one virtual plane including the rotation axis H in a circumferential direction of rotation. Each of the blades 5 has four edges that are a tip (a shroud-side edge) 11, a hub-side edge 12, a leading edge 13, and a trailing edge 14. The impeller 1 suctions a fluid from the leading edge 13 that is an inlet for the fluid in a direction of the rotation axis H, and discharges a compressed fluid from the trailing edge 14 that is an outlet in a radial direction. Hereinafter, an inlet of the tip 11 which is an intersection between the tip 11 and the leading edge 13 is referred to simply as a "tip inlet," and a reference sign 11*a* is given to the tip inlet. An outlet of the tip 11 which is an intersection between the tip 11 and the trailing edge 14 is referred to simply as a "tip outlet," and a reference sign 11*b* is given to the tip outlet.

The impeller 1 of the present embodiment is characterized in that the blade angles β of the tips 11 of the blades 5 show a distribution to be described below. Hereinafter, a definition of the "blade angle β of the tip 11" will be described.

First, a position of an arbitrary point on the tip 11 in a meridional direction shall be represented with a normalized meridional distance (a normalized meridional distance; m/m2) based on the tip inlet 11*a*. Here, a definition of the "normalized meridional distance" will be described. As illustrated in FIG. 1, in the state in which the blades 5 are projected onto the virtual plane including the rotation axis H, an arbitrary point M in the blades 5 is considered. A full length of a curve LM that extends from the leading edge 13 to the trailing edge 14 through the point M in the meridional direction is defined as m2. A length measured from the leading edge 13 to the point M along the curve LM is defined as m. At this point, the normalized meridional distance of the point M which is based on the leading edge 13 is defined by a ratio of the length m to the length m2 (i.e., m/m2). Therefore, the normalized meridional distance based on the leading edge 13 is a non-dimensional amount that has a value from 0 to 1.

This is applied to an arbitrary point J on the tip 11. As illustrated in FIG. 1, a full length of the tip 11 extending from the tip inlet 11*a* to the tip outlet 11*b* in the meridional direction is defined as k. A length measured from the tip inlet 11*a* to the point J along the tip 11 is defined as j. At this point, the normalized meridional distance of the point J which is based on the tip inlet 11*a* is represented as j/k [m/m2](where j/k=0 to 1). In this way, a position of an arbitrary point on the tip 11 in the meridional direction can be expressed with a non-dimensional value from 0 to 1 by the normalized meridional distance based on the tip inlet 11*a*.

Figure 2:
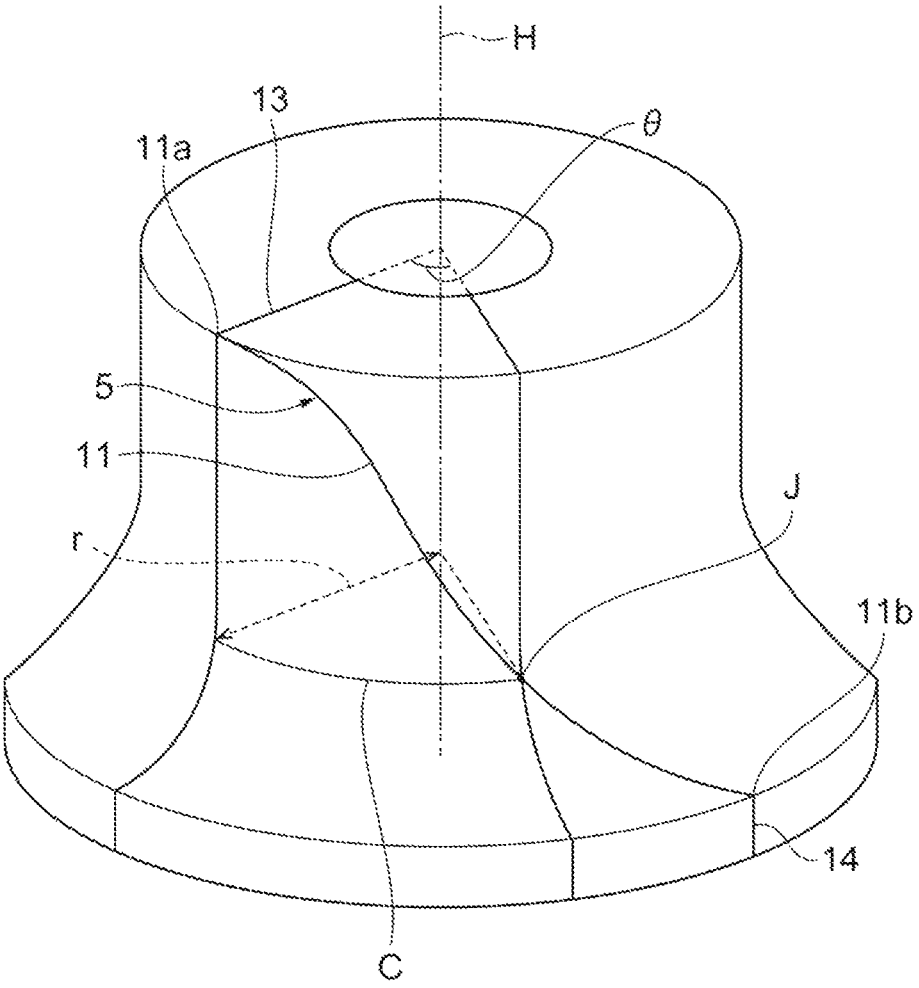
FIG. 2 is a perspective view illustrating a solid of revolution obtained by rotating a blade of the centrifugal compressor impeller about a rotation axis.

Next, to indicate the position of the arbitrary point J on the tip 11 in the circumferential direction of rotation, an "rθ value" based on the tip inlet 11*a* is introduced. FIG. 2 is a perspective view illustrating a virtual solid of revolution obtained by rotating the blade 5 of the impeller 1 about the rotation axis H. The tip 11 appears on a circumferential surface of the solid of revolution. As illustrated in FIG. 2, a phase difference between the tip inlet 11*a* and the point J in the circumferential direction of rotation is defined as θ, and a radius of rotation of the point J when the impeller 1 rotates is defined as r. At this point, the rθ value of the point J which is based on the tip inlet 11*a* is a value obtained by multiplying r by θ. This rθ value is equivalent to a length of a circular are C illustrated in FIG. 2.

Figure 3:
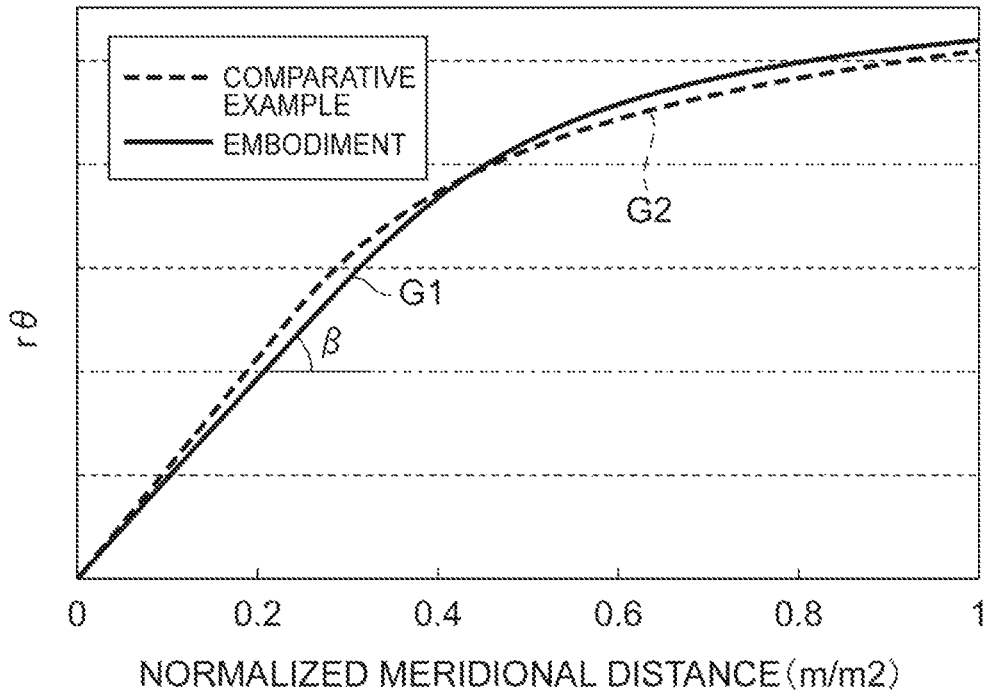
FIG. 3 is a graph illustrating a relation between a meridian plane length and an rθ value of the impeller.

Subsequently, as illustrated in FIG. 3, with regard to points on the tip 11, a coordinate system in which the normalized meridional distance based on the tip inlet 11*a* is set on the horizontal axis and the rθ value based on the tip inlet 11*a* is set on the vertical axis is considered. In the coordinate system, a graph of each point on the tip 11 from the tip inlet 11*a* (m/m2=0) to the tip outlet 11*b* (m/m2=1) is a graph G1. An inclination of a tangential line at each point of the graph G1 corresponds to the blade angle β at each point. To be specific, the blade angle β at the arbitrary point J on the tip 11 is defined by tan β=d(rθ)/dj. Here, j is a length (a dimensional amount) that is measured from the tip inlet 11*a* to the arbitrary point J along the tip 11 as described above.

Figure 4:
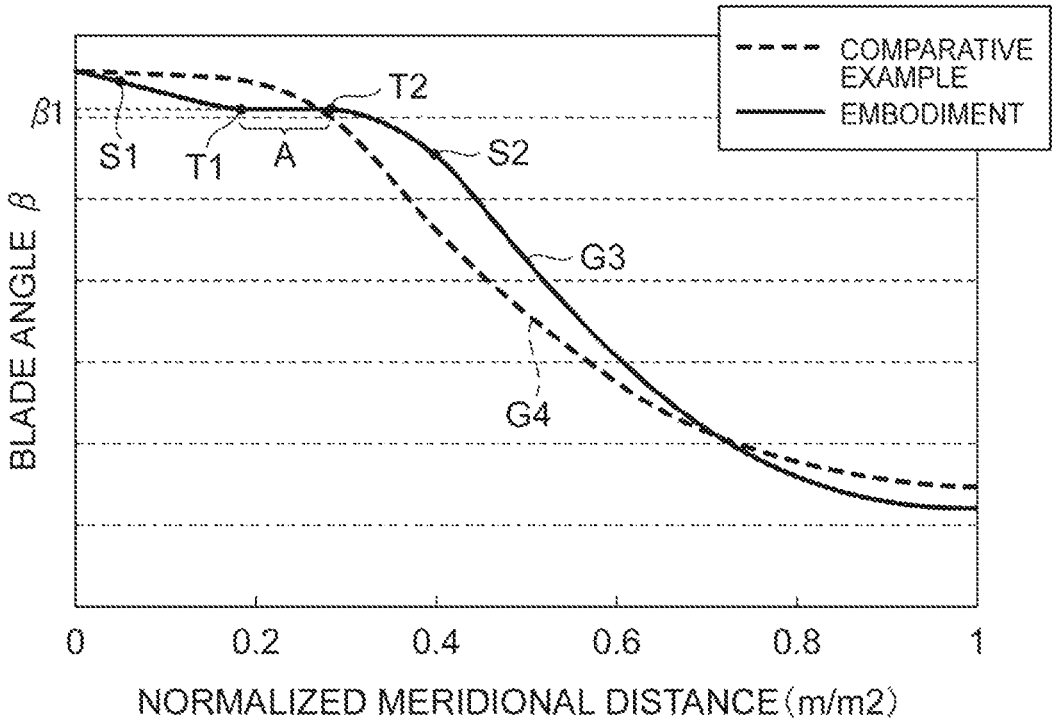
FIG. 4 is a graph illustrating a relation between a meridian plane length and a blade angle β of the impeller.

A graph G3 illustrated in FIG. 4 is a graph that shows a distribution of the blade angles β from the tip inlet 11*a* (m/m2=0) to the tip outlet 11*b* (m/m2=1) in a direction in which the tip 11 extends according to the definition of the aforementioned blade angle β.

Characteristic configurations of the impeller 1 of the present embodiment are as follows. As illustrated in FIG. 4, when the distribution of the blade angles β of the tip 11 is viewed from the tip inlet 11*a* to the tip outlet 11*b* in the direction in which the tip 11 extends, there is a constant blade angle region A in which the blade angles f are constant. A start point T1 on the tip inlet 11*a* side of the constant blade angle region A is located at a position spaced away from the tip inlet 11*a*. That is, a normalized meridional distance of the start point T1 which is based on the tip inlet 11*a* is not zero. To be specific, the normalized meridional distance of the start point T1 which is based on the tip inlet 11*a* is 0.05 m/m2 or more. The constant blade angle region A is within a region between a point S1 and a point S2. Here, a normalized meridional distance of the point S1 which is based on the tip inlet 11*a* is 0.05 m/m2. A normalized meridional distance of the point S2 which is based on the tip inlet 11*a* is 0.40 m/m2. To be specific, in the example illustrated in the graph G3 of FIG. 4, the constant blade angle region A is a region from T1 (about 0.2 m/m2) to T2 (about 0.3 m/m2).

The expression "the blade angles β are constant" means that, when the blade angle of the start point T1 of the constant blade angle region A is a blade angle β1, the blade angle β of each point on the tip 11 within the constant blade angle region A is an angle within a range of (β1±1°). As long as a condition that the blade angle β of each point on the tip 11 within the constant blade angle region A is (β1±1)° is satisfied, the blade angle β may fluctuate up and down. For example, the blade angle β may fluctuate to have a minimal value within the constant blade angle region A. A width of the constant blade angle region A is 0.05 m/m2 or more on the basis of the normalized meridional distance. To be specific, in the example illustrated in the graph G3 of FIG. 4, the constant blade angle region A is a region from about 0.2 to 0.3 m/m2, and the width of the constant blade angle region A is about 0.1 m/m2.

Next, the operation and effects of the impeller 1 as described above will be described.

In general, it is known that, in this type of centrifugal compressor impeller, a strong impulse wave occurs at the inlet under conditions of high rotation and a high pressure ratio, and a separation of a boundary layer by the impulse wave may occur. In contrast, since the blade angles β are constant in the constant blade angle region A in the impeller 1, the tip 11 has a linear shape in the constant blade angle region A. Therefore, acceleration of the fluid around the tip 11 is suppressed in the constant blade angle region A. As a result, the impulse wave is weakened, the separation of the boundary layer at the tip 11 is suppressed, and efficiency of the impeller 1 is raised.

Here, if the tip inlet 11*a* is present as a start point in the constant blade angle region A, a flow rate is reduced, which is not preferred. In contrast, as in illustrated in FIG. 4, the start point T1 of the constant blade angle region A which is close to the tip inlet 11*a* is set at a position spaced away from the tip inlet 11*a*. Therefore, in a region closer to the inlet than the start point T1, freedom of design for a flow rate of the impeller 1 is easily secured, for instance, by adopting a curve shape of the tip 11 aimed at increasing the flow rate of the impeller 1. From this viewpoint, if the normalized meridional distance of the start point T1 which is based on the tip inlet 11*a* is 0.05 m/m2 or more, the freedom of design for the flow rate can be sufficiently secured.

When a splitter blade is provided between the blades 5 of the impeller 1, a start point of each splitter blade is generally frequently disposed close to a position at which the normalized meridional distance based on the tip inlet 11*a* is 0.40 m/m2. In this case, if the separation of the boundary layer of the blade 5 occurs at a position closer to the inlet than the start point of the splitter blade, an actual flow channel is narrowed, and excessive acceleration also occurs downstream, a possibility of the separation of the boundary layer also occurring at the splitter blade is increased. In contrast, in the blade 5 of the impeller 1, the constant blade angle region A is located at a position closer to the inlet than the point S2 at which the normalized meridional distance based on the tip inlet 11*a* is 0.40 m/m2. With this configuration, when the splitter blade is present, the separation of the boundary layer in the blade 5 is suppressed at the position closer to the inlet than the start point of the splitter blade. As a result, when the splitter blade is present, the separation of the boundary layer in the splitter blade can be suppressed.

Next, a test made by the inventors in order to check the aforementioned effects based on the configuration of the impeller 1 will be described.

A model for an impeller with the above configuration of the impeller 1 (hereinafter referred to as "impeller of the embodiment") and a model for a conventional impeller without the constant blade angle region (hereinafter referred to as "impeller of the comparative example") were prepared, and CFD analysis was performed. A shape of the blade of the impeller of the embodiment is specified by the solid line graph G1 illustrated in FIG. 3 and the solid line graph G3 illustrated in FIG. 4. Likewise, a shape of the blade of the impeller of the comparative example is specified by the broken line graph G2 illustrated in FIG. 3 and the broken line graph G4 illustrated in FIG. 4.

Figure 5:
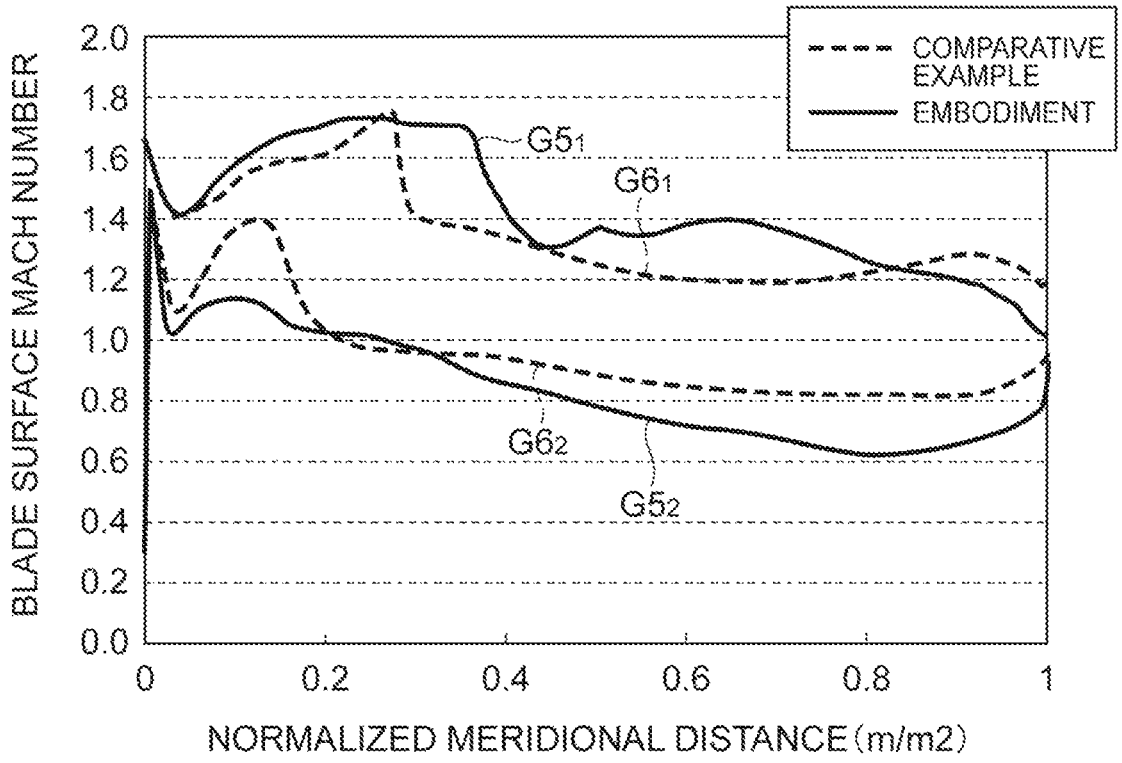
FIG. 5 is a graph illustrating a relation between a meridian plane length and a blade surface Mach number of the impeller.
Figure 6:
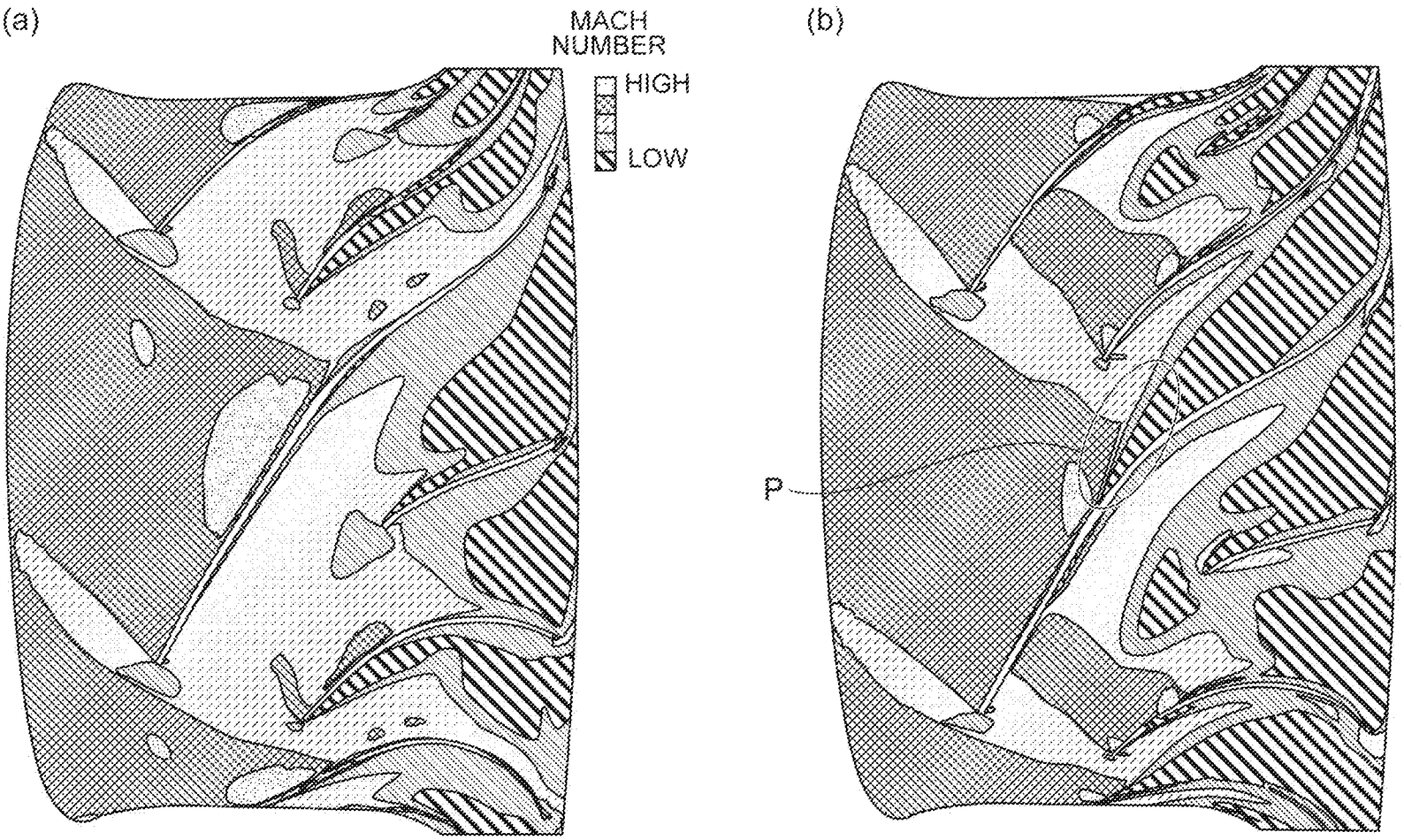
FIG. 6(*a*) is a contour plot illustrating a Mach number distribution in an impeller of an embodiment, and FIG. 6(*b*) is a contour plot illustrating a Mach number distribution in an impeller of a comparative example.
Figure 7:
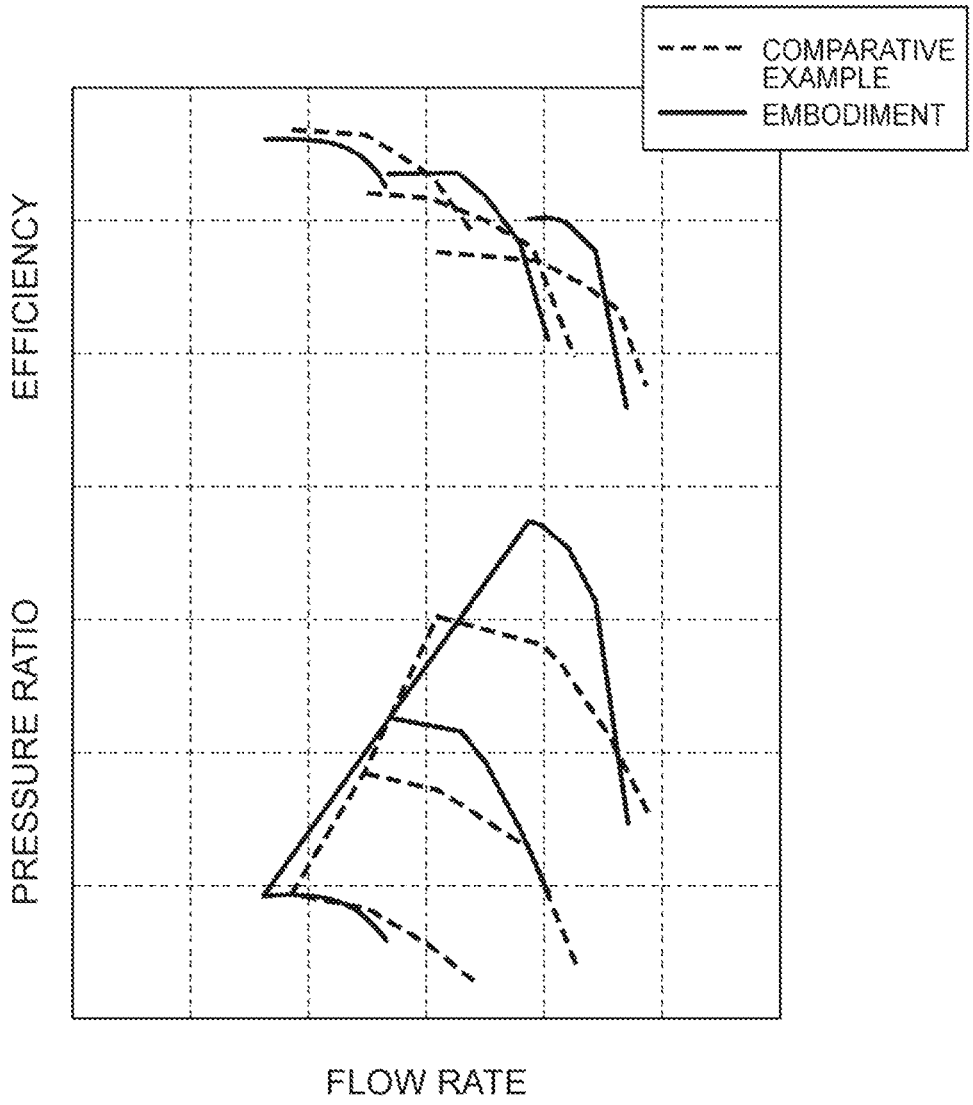
FIG. 7 is a graph illustrating a relation between a flow rate and a pressure ratio and between the flow rate and efficiency of the impeller.

Results of the CFD analysis are illustrated in FIGS. 5 and 6. FIG. 5 is a graph illustrating a blade surface Mach number distribution from the tip inlet (m/m2=0) to the tip outlet (m/m2=1) of the blade. Solid line graphs $G5_1$ and $G5_2$ correspond to the impeller of the embodiment. Of these graphs, the graph $G5_1$ is a distribution on a suction surface side of the impeller of the embodiment, and the graph $G5_2$ is a distribution on a pressure surface side of the impeller of the embodiment. Likewise, broken line graphs $G6_1$ and $G6_2$ correspond to the impeller of the comparative example. Of these graphs, the graph $G6_1$ is a distribution on a suction surface side of the impeller of the comparative example, and the graph $G6_2$ is a distribution on a pressure surface side of the impeller of the comparative example. FIG. 6 is a contour plot illustrating a Mach number distribution in the impeller, and illustrates an impeller when viewed in a direction perpendicular to a rotation axis. FIG. 6(*a*) corresponds to the impeller of the embodiment, and FIG. 6(*b*) corresponds to the impeller of the comparative example. FIG. 7 is a graph illustrating a flow rate to pressure ratio characteristic and a flow rate to efficiency characteristic of each impeller. In FIG. 7, a solid line corresponds to the impeller of the embodiment, and a broken line corresponds to the impeller of the comparative example.

In the impeller of the comparative example, as illustrated in the graph $G6_1$ of FIG. 5, a blade surface Mach number is abruptly reduced in the vicinity of 0.3 m/m2. In the impeller of the comparative example, as appearing in a site indicated by P of FIG. 6(*b*), the separation of the boundary layer caused by the impulse wave is also considered to occur. In contrast, in the impeller of the embodiment, as illustrated in FIG. 6(*a*), it is found that the separation of the boundary layer at a position corresponding to the site P is eliminated. As illustrated in the graph $G5_1$ of FIG. 5, in the impeller of the embodiment, a blade surface Mach number is relatively smoothly reduced from a position of about 0.35 m/m2. Thereby, in the impeller of the embodiment, it is found that the occurrence of the impulse wave is suppressed and the separation of the boundary layer caused by the impulse wave is suppressed. In comparison with the blade surface Mach number on the pressure surface side of the blade, it is found in the impeller of the embodiment (the graph $G5_2$) that a change in the blade surface Mach number is smooth, compared to the impeller of the comparative example (the graph $G6_2$).

As illustrated in FIG. 7, in comparison with the impeller of the comparative example, it is found in the impeller of the embodiment that the pressure ratio and the efficiency are improved, especially in a region of a high flow rate under a condition of the number of rotations in which the impulse wave occurs. As described above, an effect of improving the efficiency with the configuration of the impeller 1 was confirmed.

Starting with the aforementioned embodiment, the present invention can be carried out in various modes that are variously modified and improved on the basis of the knowledge of those skilled in the art. Modifications can also be configured using technical features set forth in the aforementioned embodiment. The configurations of embodiments may be adequately combined and used.

REFERENCE SIGNS LIST

1 Impeller
5 Blade
13 Leading edge (inlet)
14 Trailing edge (outlet)
A Constant blade angle region
T1 Start point
β Blade angle

The invention claimed is:

1. A centrifugal compressor impeller, comprising:

blades extending from an inlet to an outlet for a fluid, wherein each of the blades includes a tip and a distribution of blade angles of points on the tip extending from a tip inlet to a tip outlet of the tip includes a constant blade angle region in which the blade angles are substantially constant, each blade angle based on a phase difference between the tip inlet and a respective point of the points, a radius of rotation of the respective point from a rotation axis of the impeller, and a distance measured from the tip inlet to the respective point along the tip;

a start point on the inlet side of the constant blade angle region is set at a position spaced apart from the inlet;

the constant blade angle region is present within a region between a point at which a normalized meridional distance from the inlet is 0.05 m/m2 and a point at which the normalized meridional distance from the inlet is 0.40 m/m2;

the blade angle of each point within the constant blade angle region is an angle within a range of (β1±1)° when the blade angle at the start point on the inlet side is set to a blade angle (β1);

a width of the constant blade angle region is 0.05 m/m2 or more on the basis of the normalized meridional distance; and the distribution of the blade angles has a minimal value within the constant blade angle region.

* * * * *